United States Patent [19]

Stewart et al.

[11] Patent Number: 4,887,960

[45] Date of Patent: Dec. 19, 1989

[54] AUTOMATIC FLAME SNUFFER ASSEMBLY

[76] Inventors: Jack Stewart, 3050 Rue D' Orleans, San Diego, Calif. 92110; Jim Lowe, P.O. Box 1888, Alpine, Calif. 92001

[21] Appl. No.: 223,396

[22] Filed: Jul. 25, 1988

[51] Int. Cl.[4] ..... F23Q 25/00; F23D 3/18

[52] U.S. Cl. ..... 431/146; 431/144; 431/34

[58] Field of Search ..... 431/33, 34, 144, 145, 431/148, 146, 152, 315, 323, 324, 344, 320

[56] References Cited

U.S. PATENT DOCUMENTS

| | | | |
|---|---|---|---|
| 3,885,905 | 5/1975 | Giangiulio | 431/146 X |
| 4,025,290 | 5/1977 | Giangiulio | 431/146 X |
| 4,496,307 | 1/1985 | Ginardi | 431/146 X |
| 4,526,530 | 7/1985 | Menter et al. | 431/146 X |

FOREIGN PATENT DOCUMENTS

| | | | |
|---|---|---|---|
| 2135441 | 8/1984 | United Kingdom | 431/144 |

*Primary Examiner*—Carl D. Price

*Attorney, Agent, or Firm*—Charles C. Logan, II

[57] ABSTRACT

An automatic flame snuffer assembly that is detachably connected to the neck of a sealing cap that is located on a fuel lamp container. The fuel lamp container holds fuel oil having a flash temperature of approximately 240 degrees and it is used in churches, restaurants, etc. in place of candles. A wick extends up through an aperture in the top end of the sealing cap of the fuel lamp container and also upwardly through the automatic flame snuffer assembly. The automatic flame snuffer assembly has an assembly mounting sleeve and a snuffer member that are interconnected together to function to snuff out the flame on the wick of the fuel lamp container when it is tipped over.

2 Claims, 1 Drawing Sheet

AUTOMATIC FLAME SNUFFER ASSEMBLY

BACKGROUND OF THE INVENTION

The invention relates to a flame snuffer structure and more specifically to one that is detachably connected to a fuel lamp container having lamp fuel oil therein. This type of container is used in churches, restaurants, etc. for lighting. This was formerly accomplished by wax candles. Oftentimes the fuel lamp container is positioned within a lamp housing.

In the past, one of the problems encountered with the use of fuel lamp containers having lamp fuel oil therein has been the problem with potential fire damage if the container is knocked over while lit. Since most of these lamp containers are used in public places such as restaurants and churches, the fire departments are especially concerned that the structure have an automatic snuff out wick in case the unit is knocked over.

Since it is important to have some type of flame snuffing structure on a fuel lamp container when in use, it is more desirable that the flame snuffing structure be removable so it can be used over and over instead of having a permanently attached structure for each fuel lamp container.

It is an object of the invention to provide a novel automatic flame snuffer assembly that is detachably connectable to the neck portion of the sealing cap of a fuel lamp container.

It is also an object of the invention to provide a novel automatic snuffer assembly that is economical to manufacture and market.

It is another object of the invention to provide a novel automatic snuffer assembly that can be used over and over once the fuel oil in the present fuel lamp container has been used.

It is an additional object of the invention to provide a novel automatic snuffer assembly that can be installed and removed from a fuel lamp container without the need for tools.

SUMMARY OF THE INVENTION

Applicants' novel automatic flame snuffer assembly has been designed so that it is removably detachable to the neck portion of the sealing cap of a fuel lamp container. Thus it can be used over and over once the lamp fuel oil in the fuel lamp container has all been burned.

The automatic flame snuffer assembly is comprised of two parts, a snuffer member and an assembly mounting sleeve. The assembly mounting sleeve has a cylindrical wall portion with an outwardly extending annular flange at its top edge. The snuffer member has a cylindrical side wall having a top wall with a wick aperture centrally located therein. An inwardly extending annular lip is formed at the bottom of the side walls of the snuff member. The diameter of the annular flange of the assembly mounting sleeve is greater than the inner diameter of the annular lip extending inwardly from the bottom of the cylindrical side walls of the snuffer member. Thus the assembly mounting sleeves captured within the snuffer member and can not be detached therefrom. The inner diameter of the cylindrical side walls of the stuffer member are greater than the outer diameter of the annular flange of the assembly mounting sleeve so that a predetermined amount of horizontal sliding action can take place between the two members. This structure is important when the fuel lamp container is knocked over since it allows the snuffer member to slide horizontally with respect to the top of the assembly mounting sleeve and then gravity takes over and allows the snuffer member to flop downwardly to cover the wick of the fuel lamp container and thus extinguish its flame.

The two parts of the automatic flame snuffer assembly are preferably made of brass material but other materials can also be used. The assembly mounting sleeve has an inner diameter substantially the same as the outer diameter of the neck portion of the sealing cap of the fuel lamp container so that it can be slid thereon and held in place by a friction fit.

DESCRIPTION OF THE PREFERRED EMBODIMENT

Figure 1:
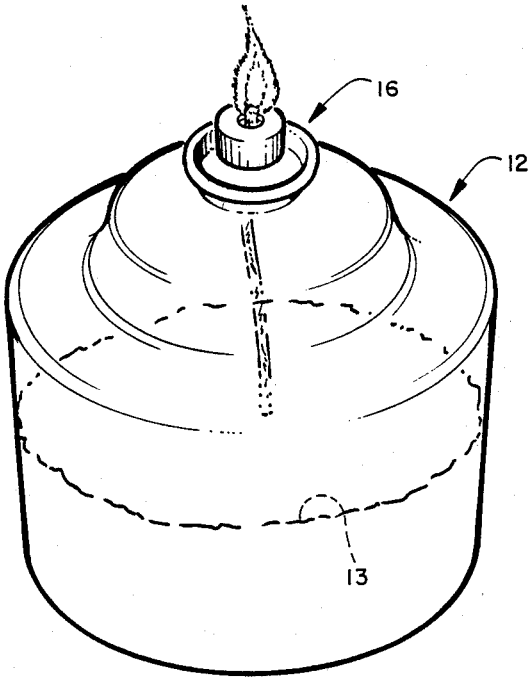
FIG. 1 is a perspective view illustrating a fuel lamp container having lamp fuel oil therein.
Figure 2:
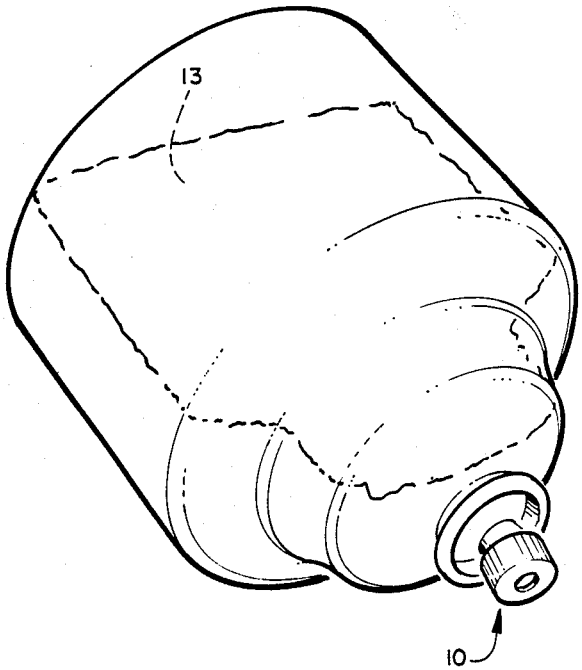
FIG. 2 is a perspective view illustrating the fuel lamp container having been tipped over and having the flame snuffed out.
Figure 3:
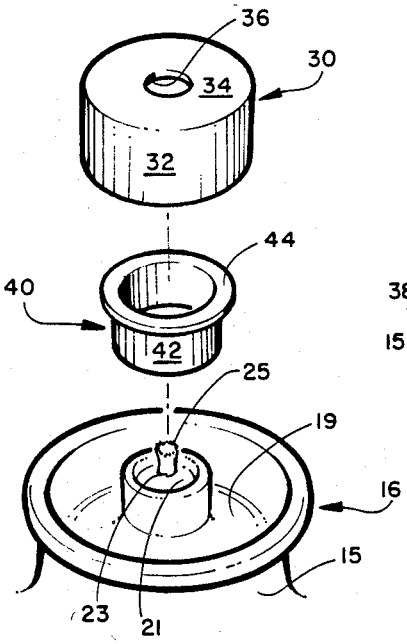
FIG. 3 is an exploded perspective view illustrating parts of the automatic flame assembly and the structure of the fuel lamp container to which it is attached.
Figure 4:
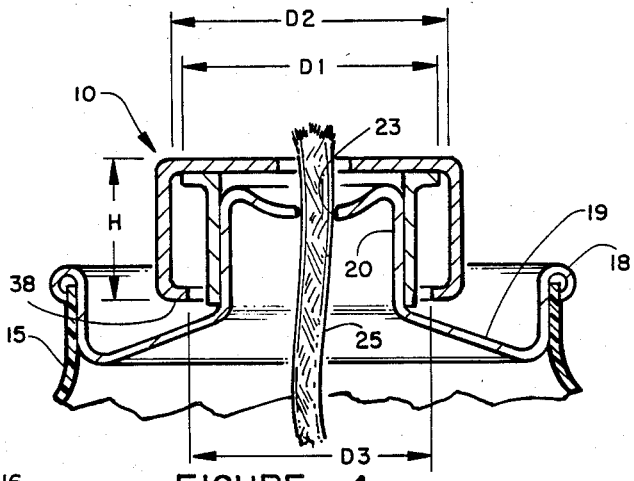
FIG. 4 is an enlarged vertical cross-sectional elevation view of the automatic flame snuffer assembly and the top of the fuel lamp container.
Figure 5:
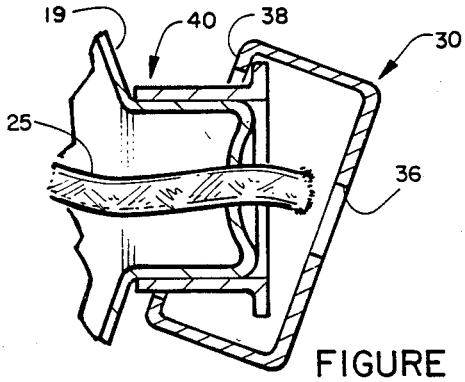
FIG. 5 is an enlarged vertical cross-sectional view illustrating the manner in which the automatic flame snuffer assembly drops down to cover the wick and extinguish the flame.

Applicants' novel automatic snuffer assembly for fuel lamp containers will now be described by referring to FIGS. 1-5 of the drawing. The automatic snuffer assembly is generally designated numeral 10.

Automatic snuffer assembly 10 is detachably connected to a fuel lamp container 12 having lamp fuel oil 13 therein. Lamp fuel container 12 can be a plastic bottle or metal can or any other type of container having a neck 15 to which a sealing cap 16 is attached. Sealing cap 16 has an annular rolled flange 18, an annular disc portion 19, a cylindrical neck 20, and a top wall 21. A wick aperture 23 is formed in the central portion of top wall 21. A wick 25 extends upwardly through wick aperture 23.

The automatic snuffer assembly 10 is made of two parts. snuffer member 30 and assembly mounting sleeve 40. Snuffer member 30 has a cylindrical side wall 32, and a top wall 34 having a wick aperture therein. An inwardly extending annular lip 38 is formed on the bottom edge of cylindrical side wall 32.

Assembly mounting sleeve 40 has a cylindrical wall portion 42 and an annular flange 44. The outer diameter D1 of annular flange 44 is greater than the inner diameter D3 of annular lip 38 so that these two parts cannot be separated from each other. The inner diameter of D2 of cylindrical side wall 32 is greater than the outer diameter D1 of annular flange 44 by a predetermined amount so that the snuffer member 30 is capable of a horizontal sliding action when the fuel lamp container 12 is knocked over. The height H of snuffer member 30 is such that when the fuel lamp container 12 is knocked over, snuffer member 30 makes a horizontal sliding action and then there is a gravity drop of the snuffer member 30 causing it to drop downwardly at an angle which snuffs out the flame (see FIG. 5).

What is claimed is:

1. The combination of an automatic flame snuffer assembly and a fuel lamp container comprising:

a fuel lamp container having lamp fuel oil therein, said container having a sealing cap in its top end, said sealing cap having a cylindrical neck with a top wall that has a wick aperture therein, an elongated wick having its bottom end immersed in said lamp fuel oil and its top end extending upwardly through said wick aperture a predetermined height;

flame snuffer means for automatically snuffing out the flame on the wick of the fuel lamp container when the lamp is tipped over comprising an automatic flame snuffer assembly having an assembly mounting sleeve and a snuffer member, said assembly mounting sleeve having a cylindrical portion that is detachably friction fit on the cylindrical neck of said sealing cap, a radially outwardly extending flange is formed on the top end of said cylindrical wall portion, the snuffer member loosely fits over said assembly mounting sleeve, said snuffer member having a horizontally oriented disc-shaped top wall that covers the top wall of the cylindrical neck of said sealing cap, said disc-shaped top wall having a central aperture therein, a cylindrical side wall extends downwardly from said top wall, a radial inwardly extending flange is formed on the bottom edge of said cylindrical wall;

the annular flange of said assembly mounting sleeve has a predetermined diameter D1 that is less than the internal diameter D2 of a cylindrical side of a snuffer member so that the snuffer member is allowed to perform a horizontal sliding action when the fuel lamp container is knocked over and the automatic snuffer assembly performs its function; and the predetermined internal diameter D3 of the inwardly extending flange is less than the predetermined diameter D1 of the assembly mounting sleeve to prevent them from becoming disconnected from each other.

2. The combination recited in claim 1 wherein the predetermined height H of the cylindrical side wall of the suffer member is such that during the action produced by the fuel lamp container being knocked over, the top end of the snuffer member will flop downwardly thereby covering the wick of the fuel lamp container and automatically extinguish the flame.

* * * * *